United States Patent [19]

Shimizu

[11] 3,939,522

[45] Feb. 24, 1976

[54] TOOTHBRUSH

[76] Inventor: Hiromichi Shimizu, 26, 4-chome, Kuwazu-cho, Higashisumiyoshi, Osaka, Japan

[22] Filed: July 22, 1974

[21] Appl. No.: 490,392

[52] U.S. Cl. ..... 15/244 R; 128/62 A

[51] Int. Cl.[2] ..... A61H 13/00

[58] Field of Search..... 15/104.94, 110, 188, 244 R, 15/244 A, 244 CH; 128/62 A; 401/11

[56] References Cited

UNITED STATES PATENTS

| | | | |
|---|---|---|---|
| 1,908,510 | 5/1933 | Dodson | 15/244 R UX |
| 2,092,438 | 9/1937 | Wilt | 15/104.94 UX |
| 2,736,917 | 3/1956 | Goldstein et al. | 128/62 A X |
| 2,819,482 | 1/1958 | Applegate | 15/110 |
| 2,946,072 | 7/1960 | Filler et al. | 128/62 A X |
| 3,317,944 | 5/1967 | Napier et al. | 15/244 R |
| 3,424,150 | 1/1969 | Meranto | 15/110 X |
| 3,458,268 | 7/1969 | Wozab et al. | 15/244 R X |
| 3,491,396 | 1/1970 | Eannarino et al. | 128/62 A X |

FOREIGN PATENTS OR APPLICATIONS

| | | | |
|---|---|---|---|
| 549,579 | 10/1956 | Italy | 15/244 R |
| 1,349,850 | 12/1963 | France | 15/244 R |
| 1,153,007 | 9/1957 | France | 15/244 A |
| 1,076,916 | 4/1954 | France | 15/244 CH |

*Primary Examiner*—Daniel Blum

*Attorney, Agent, or Firm*—Olson, Trexler, Wolters, Bushnell & Fosse, Ltd.

[57] ABSTRACT

Toothbrush having a rigid handle and a head part with a multicellular resilient pad made of compressible polyurethane sponge, the pad having a configuration of a hexagonal cylinder, one of which surfaces is provided with a concavity. The concavity has a gutter or gutters parallel to the axis of the hexagonal cylinder. The pad may have a groove or grooves parallel to the axis of the hexagonal cylinder on the back side surface of the pad.

8 Claims, 9 Drawing Figures

TOOTHBRUSH

BRIEF SUMMARY OF THE INVENTION

This invention relates generally to a toothbrush and is particularly directed toward a novel toothbrush, using a multicellular resillent pad, which can be used to massage both the exterior and the interior sides of the gums as well as to clean the teeth.

It is common knowledge that massaging the gums is very effective to maintain and promote the health of the teeth. A conventional type toothbrush has had bristles on the head part of the handle of the brush so that it has structurally not been fit for massaging the gums, and even if used for massaging, it has not achieved satisfactory effects. What is worse, there has been a possibility that the gums get wounded. Further, it has been thought desirable and necessary, on cleaning the teeth, to move the toothbrush up and down. However, the up-and down motion on cleaning the teeth can be said to be rather unnatural from the viewpoint of the structure of the mouth.

Further, it has been rather difficult to produce a conventional toothbrush in a continuous and rapid method due to its structure, and therefore it has not been produced at low cost.

With the foregoing and other considerations in view, the principal object of this present invention is to provide a toothbrush of which configuration and structure are extremely fit for massaging the gums as well as for cleaning the teeth in the common sense.

Another important object of the invention is to provide a toothbrush which can achieve excellent effects to promote and maintain the health of the mouth, viewed from the angle of human engineering, through a different function of the brush pad with rather peculiar configuration from that of a conventional bristle type toothbrush.

Another important object of the present invention is to provide a toothbrush which can remove effectively nicotine on the teeth. A further important object is to provide a toothbrush which will not wound the gums. A still further important object of the present invention is to provide a toothbrush which will retain its structural integrity and maintain its effective massaging function after many uses. An additional important object of the invention is to provide a toothbrush which can be produced at significantly lower cost than a permanent toothbrush of a conventional type and in rapid and continuous way. Still a further object of the present invention is to provide a toothbrush which may disposed after single use as well as can be used many times.

BRIEF DESCRIPTION OF THE DRAWINGS

Other and further objects and advantages of the present invention will become apparent from the following description of embodiments with reference to the accompanying drawings, in which.

DETAILED DESPRIPTION OF THE INVENTION

Figure 1:
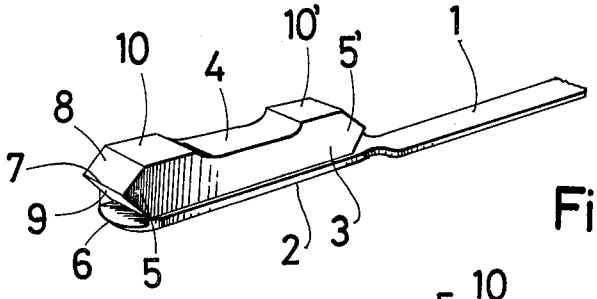
FIG. 1 is a partial perspective view of one embodiment of the toothbrush of the present invention.

Referring now to the drawings, wherein like reference characters designate like or corresponding parts throughout, first to FIG. 1, there is shown one possible embodiment of the present invention comprising the brush handle designated by the numeral 1, which can be made of rigid, low cost material such as wood, bamboo or plastic material, the brush head 2, which is continuation of the brush handle 1, and the pad 3 fixed at the brush head 2, the pad being made of multicellular resilient material such as polyurethane or the like. The pad 3 has a configuration of a hexagonal cylinder of which section perpendicular to the axis thereof is a variant hexagon along one of the diagonal lines of the hexagon, the hexagonal cylinder having, on one side-surface thereof, one arch-wise or rectangular cave-in along the axis of the cylinder across the sidesurface, to form a concavity 4. The pad 3 is longitudinally fixed to the brush handle 1 at the head part 2 thereof so that the concavity 4 lies upwards and the projecting part 5 of the hexagonal cylinder extends a little beyond the top 6 of the brush head 2, the projecting part 5 being formed by one of the edges 7 parallel to the axis of the cylinder and the two sloping surfaces 8 and 9 of the cylinder adjoining with the edge 7, and being continuation of the top surface 10 and the back surface 11 of the pad 3.

Figure 2:
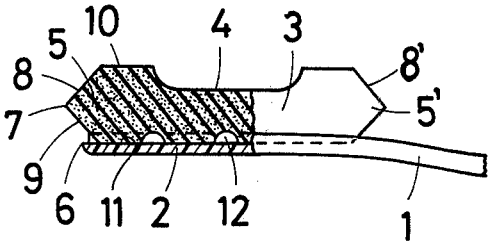
FIG. 2 is a partly sectional elevational view of the toothbrush of FIG. 1 of the present invention.

Referring to FIG. 2, which shows an embodiment of the toothbrush of the present invention as a partial sectional elevational view, the pad 3 has a groove 12 or a plurality of grooves at intervals along the axis of the hexagonal cylindrical pad 3 on the back surface 11 thereof, which grooves 12 form voids between the pad 3 and the mounting surface of the brush head 2. The grooves 12 may or may not be across the back surface of the pad 3.

Figure 3:
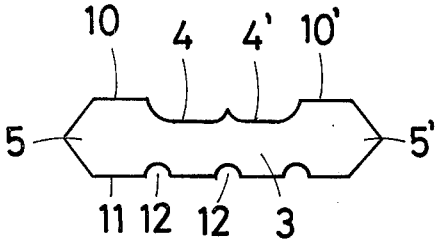
FIG. 3 is an elevational view of another embodiment of the brush pad of the present invention.

The configuration of the concavity can be varied, of course. For instance, as shown in FIG. 3, the concavity may comprise two gentle arch-wise cave-ins 4 and 4′ along the axis of the hexagonal cylindrical pad 3 through the surface.

Figure 4:
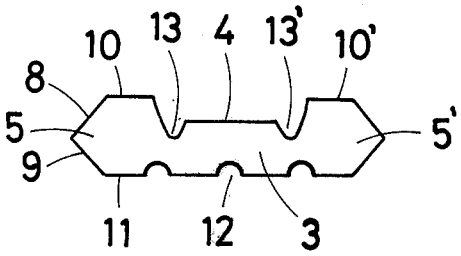
FIG. 4 is also an elevational view of an embodiment of the brush pad of the present invention.
Figure 5A:
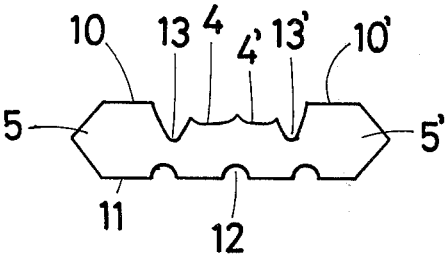
FIG. 5*a* and 5*b* are elevational views of still further embodiments of the brush pad of the present invention.
Figure 5B:
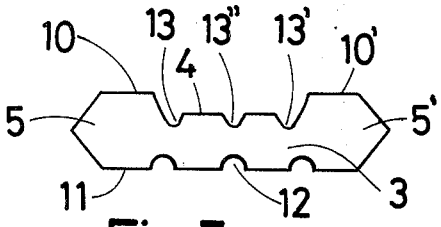

FIG. 4 also shows a partial sectional view of another embodiment of the toothbrush of the present invention, wherein the pad 3 has two gutters 13 and 13′ along the axis of the hexagonal cylindrical pad 3 between the top plane 10 and 10′ and the hollowed plane 4. In this case, the concavity may comprise two gentle arch-wise cave-ins as shown in FIG. 5*a*. More number of gutters can be provided with the concavity 4 at intervals. For instance, another gutter 13″ can be provided with the concavity 4 at the center part thereof, as shown in FIG. 5*b*.

Figure 6:
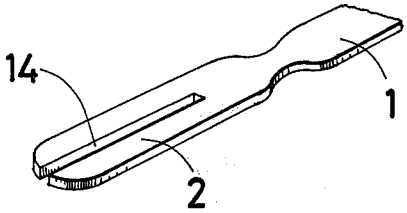
FIG. 6 is a partial perspective view of an embodiment of the brush head of the present invention.
Figure 7:
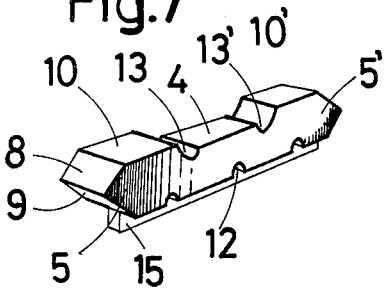
FIG. 7 is a perspective view of a still further embodiment of the brush pad of the present invention.
Figure 8:
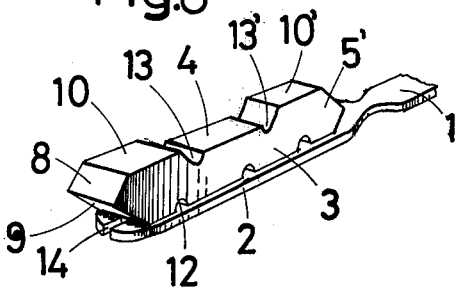
FIG. 8 is a partial perspective view of the toothbrush in which the brush pad of FIG. 7 is fixed to the brush head of FIG. 6.

The pad 3 can be simply adhered and fixed to the brush head 2 by means of adhesives. FIG. 6 through FIG. 8 show embodiments of the toothbrush of the present invention, where FIG. 6 shows an embodiment of the brush head 2 of the invention and, in which a slit 14 is provided with the brush head 2. The slit 14 can be replaced by a channel (not shown in the figure). FIG. 7 shows an embodiment of the pad 3 of the invention, in which the back side 11 thereof is provided with a longitudinally extending continuous projection 15 of which width is equal to or a little larger than that of the slit 14 or the channel. In this case, grooves 12 may or may not penetrate through the projection 15. When penetrating the projection 15, grooves are replaced by holes. FIG. 8 shows the toothbrush in which the pad 3 of FIG. 7 is inserted into the slit 14 and fixed to the brush head 2 of FIG. 6.

As set forth above, according to the present invention, the pad 3 has a configuration of a hexagonal cylinder, wherein one of the edges 7 parallel to the axis of the cylinder and the two sloping surfaces 8 and 9 define the projecting part 5 which is continuation of the top surface 10 and the back surface 11 of the pad 3. Therefore, when the pad 3 is pressed to the gums and/or the teeth, the pad 3 is distorted or squashed, that is, the top surface 10 is elongated or enlarged while one of the sloping surface 9 is reduced, and particularly the edge 7 comes closer to the plane involving the surface of the brush head 2. Accordingly, not only the top surface 10 and, as the case may be, the sloping surface 8 exert a strong repulsive force on the gums and/or the teeth to attain excellent massaging effects, but also the concavity 4 does the same since the concavity 4 comes upwards to contact with the gums and/or the teeth to massage them due to the distortion or the squash of the projecting part 5. The grooves 12 on the back side 11 of the pad 3 can serve to adjust the quantity of the distortion or the depression of the projecting part 5 and the pad 3 as a whole. This adjustment function of the grooves 12 is useful when, for instance, the toothbrush is directed to the old or the infant. Many grooves lead to easy distortion of the pad 3, that is, a weak massaging, while one or two grooves require relatively much force to distort the pad 3, in other words, a small number of grooves lead to strong massaging effect for the gums and/or the teeth.

In addition, since the projecting part 5 extends a little beyond the top part 6 of the brush head 2, and goes beyond the top 6 and comes to cover the top 6 when pressed to the gums and/or the teeth, the gums will not be wounded.

More effective massaging effects of the gums and cleaning of the teeth is accomplished by the toothbrush where the pad 3 is provided with one or more gutters 13 between the top surfaces 10 and 10' and the concavity 4. Particularly in case there are two gutters each between the top surface 10 or 10' and the concavity 4 each being continuative to both the top surface 10 or 10' and the concavity 4, as shown in FIG. 4, each of the projecting parts 5 and 5' and the concavity 4 act relatively independently when the pad 3 is pressed to the gums and/or the teeth, and rubbed. Therefore, almost all the surfaces 10, 10' , 8 and 8' massage independently the gums clean the teeth, and thus the toothbrush can be very effectively and comfortably used as massaging means as well as cleaning means. In this case also, the grooves 12 in conjunction with the gutters 13 can serve for adjustment of the repulsive force, i.e., the massaging effects of the pad 3.

As above described, the tooth brush according to the present invention has excellent massaging effects of the gums as well as cleaning effects, and can be used for the old and the infant as well as the adult through the adjusting the repulsive force of the pad 3 by choice of the number of the gutters 13 and the grooves 12 of the pad 3.

It should be understood that the foregoing relates to only a preferred embodiment of the invention, and that it is intended to cover all changes and modifications of the examples of the invention herein chosen for the purposes of the disclosure, which do not constitute departures from the spirit and scope of the invention.

What is claimed is:

1. A toothbrush having a rigid handle, a head on one end of the handle and a multicellular, resilient, compressible sponge pad fixed on a pad mounting surface of the head, said sponge pad having a configuration of a hexagonal cylinder of which a section perpendicular to the mounting surface of the head is hexagonal elongated along a line parallel to the longitudinal direction of the handle, and upper side-surface parallel to the mounting surface of the hexagonal cylinder, said upper surface having a concavity of relatively large area along the axis of the hexagonal cylinder to form two planar top surfaces on opposite sides of the concavity, the under side-surface of the hexagonal cylinder contacting the pad mounting surface being provided with at least one groove through the pad along the axis of the hexagonal cylinder, and the pad being located on the mounting surface so that one of the longitudinally projecting parts between the top surface and the under side surface of the pad extends beyond the free end of the head.

2. A toothbrush as defined in claim 1 wherein at least one gutter is provided in said concavity.

3. A toothbrush as defined in claim 2 wherein the pad has a plurality of gutters in the concavity parallel to the axis of the hexagonal cylinder.

4. A toothbrush as defined in claim 2 wherein the pad involves two gutters in the concavity, each gutter being continuous to a said top surface.

5. A toothbrush as defined in claim 4 wherein the pad has another gutter at the center part of the concavity.

6. A toothbrush as defined in claim 1 wherein the pad has a continuous projection on the back side of the pad.

7. A toothbrush as defined in claim 6 wherein the pad is fixed by insertion of the continuous projection into a slit in the head of the handle.

8. A toothbrush as defined in claim 7 wherein the head has a channel to receive said continuous projection.

* * * * *